United States Patent [19]

Takahashi et al.

[11] Patent Number: 4,458,649

[45] Date of Patent: Jul. 10, 1984

[54] FUEL INJECTION PUMP FOR INTERNAL COMBUSTION ENGINES

[75] Inventors: Ikuo Takahashi, Katsuta; Yoshikazu Hoshi, Tohkai, both of Japan

[73] Assignee: Hitachi, Ltd., Tokyo, Japan

[21] Appl. No.: 355,693

[22] Filed: Mar. 8, 1982

[30] Foreign Application Priority Data

Mar. 11, 1981 [JP] Japan ..... 56-33952

[51] Int. Cl.[3] ..... F04B 19/00; F02M 39/00

[52] U.S. Cl. ..... 123/450; 123/458; 417/462; 417/505

[58] Field of Search ..... 123/450, 458, 500, 501, 123/451; 417/462, 253, 221, 222, 505

[56] References Cited

U.S. PATENT DOCUMENTS

| | | | |
|---|---|---|---|
| 3,598,507 | 8/1971 | Voit | 123/450 |
| 3,628,895 | 12/1971 | Drori | 123/450 |
| 4,292,012 | 9/1981 | Brotherston | 123/450 |
| 4,382,751 | 5/1983 | Potter | 417/462 |

*Primary Examiner*—Charles J. Myhre
*Assistant Examiner*—Carl S. Miller
*Attorney, Agent, or Firm*—Antonelli, Terry & Wands

[57] ABSTRACT

Two solenoid valves having needle valves to control the supply of fuel to a rotary distributor are mounted in such a manner that the needle valves move in a direction tangent to the rotating circle of a rotary distributor.

7 Claims, 6 Drawing Figures

FUEL INJECTION PUMP FOR INTERNAL COMBUSTION ENGINES

BACKGROUND OF THE INVENTION

This invention relates to a fuel injection pump for internal combustion engines provided with a solenoid valve to control the supply of injection fuel to the fuel distributor.

In, for example, U.S. Pat. No. 3,628,891, a fuel injection pump, driven in synchronism with an engine, is equipped with a fuel distributor, with solenoid valves for controlling the supply of injection fuel to the fuel distributor are being generally disposed in such a manner that the longitudinal direction of the solenoid valves, i.e., the needle valve displacement direction, is the radial direction of the rotary distributor, and with the fuel injection pump being mounted so that the rotating shaft of the rotary distributor is parallel to the rotating shaft of the internal combustion engine.

Therefore, when the solenoid valves are mounted to the injection pump, not only does the outer diameter of the pump body become large but the pump weight also increases. Another disadvantage is that when the vibration generated by the engine is transmitted to the fuel injection pump, the direction of movement of the needles of the solenoid valves coincide with the direction of the engine vibration, adversely affecting the solenoid valves.

SUMMARY OF THE INVENTION

The object of this invention is to provide the fuel injection pump for internal combustion engines which overcomes the aforementioned conventional drawbacks and which is compact, light weight and almost free from the adverse effects of the engine vibration on the solenoid valves.

To achieve this object, this invention is characterized in that the solenoid valves to control the supply of fuel to the rotary distributor are mounted in such a manner that the needle valves move in the direction tangent to the rotating circle of the rotary distributor.

DESCRIPTION OF THE PREFERRED EMBODIMENT

Figure 1:
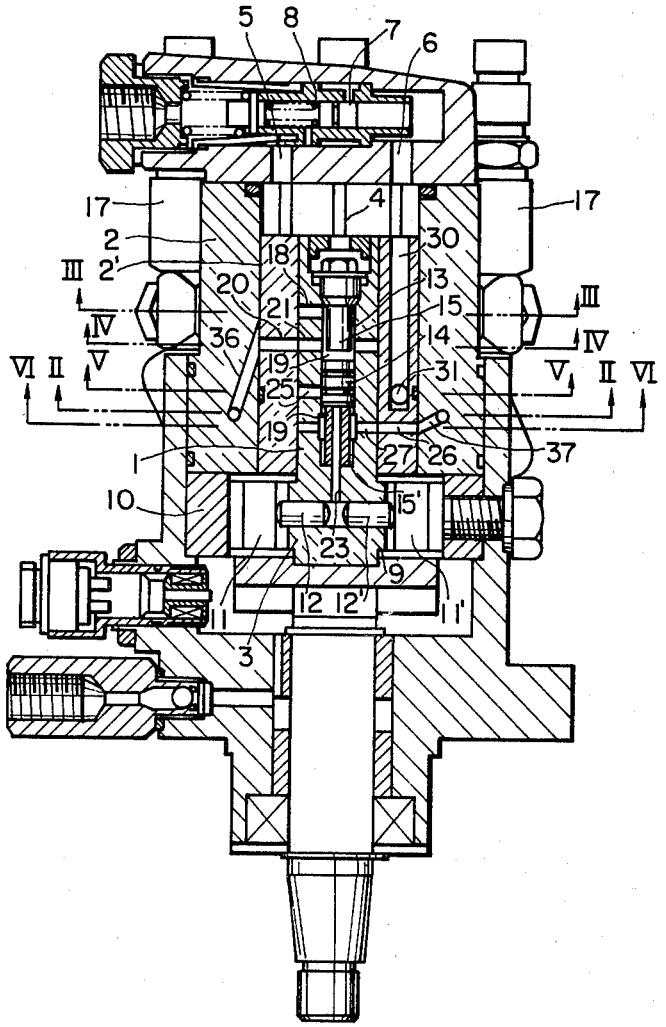
FIG. 1 is a cross sectional view of the fuel injection pump embodying the present invention.

Referring to FIGS. 1 through 6, a rotary distributor, driven in synchronism with the internal combustion engine (not shown), is installed in a sleeve 2' of a body 2. A pressure pump rotor 3 is provided at one end of the distributor 1 and a rotating portion of the vane type supply pump 4 is installed at the other end of the distributor 1. The supply pump 4 has an inlet 5 and an outlet 6 formed in the body 2, the inlet 5 being connected to the fuel source (not shown) during operation. The inlet 5 and the outlet 6 are interconnected by an orifice 7, the size of which is determined by spring-loaded valve member 8 to adjust the pressure at the outlet 6.

The rotor 3 has a radial hole 9 formed therein into which a pair of slidable pungers 12, 12' are press-fitted. While the distributor 1 is rotating, the pair of plungers 12, 12' are slid inward by the action of the annular cam 10 through the roller intermediate member 11, 11' both installed in the body 2. The radial hole 9 is communicated with one end of the longitudinal passage or central axial bore 13 in the distributor 1 in which a shuttle or free piston 14 is slidably disposed, with the amount of displacement of the piston or shuttle 14 being determined by a pair of stoppers 15 disposed at opposite ends of the shuttle 14.

A delivery passage 18 extends from an action chamber 19 at the point beyond the extreme position of the shuttle 14, with the delivery passage 18, when the distributor 1 being rotating, is brought into communication with a plurality of delivery ports 16, (FIG. 3) one at a time. The delivery ports 16 are formed in the sleeve 2' equiangularly spaced from each other. The delivery passage 18 is also communicated with each cylinder of the engine through the delivery port 16 and a pressure valve 17. The same number of equiangularly spaced inlet passages 21 as that of the delivery ports 16 are formed extending from the action chamber 19 at the point beyond the extreme position of the shuttle 14. When the distributor 1 is rotating, the inlet passages 21 are brought into the inlet port 20 formed in the sleeve 2'. The inlet port 20 and the inlet passages 21 are so arranged that they will communicate with each other when at least the delivery passage 18 is not aligned with one of the delivery ports 16. At the rear edge of the shuttle 14, a relief passage 25 extends from the action chamber 19. The relief passage 25, when the distributor 1 is rotating, is brought into communication with the equiangularly spaced relief ports 22 (FIG. 5), with the number of relief ports being the same as the number of the delivery ports 16 formed in the sleeve 2'. When not closed by the rear edge of the shuttle 14, the relief passage 25 stops the further movement of the shuttle 14 and passes the residual fuel staying in the pressure pump chamber 23 into the storage groove 24 through the relief port 22. A plurality of equiangularly spaced timing passages 27, the same in number as the delivery ports 16, extend from the action chamber 19 at the point beyond the extreme position of the shuttle 14 on the side of the relief ports 22. The timing passages 27, when the distributor 1 is rotating, are brought into communication with the timing port 26 formed in the sleeve 2'.

The communication between the relief port 22 and the relief passage 25 occurs when at least the delivery passage 18 is aligned with the delivery port 16. The communication between the timing port 26 and the timing passage 27 takes place when at least the delivery passage 18 is not aligned with the delivery port 16.

Two solenoid valves 28, 28' (FIG. 2) are mounted to the body 2 in such a way that their valve needles 29 are disposed in the direction tangent to the rotating circle of the distributor 1. The outlet 6 is always communicated with the suction space 33 at the mounting portion of the solenoid valve 28, via the outlet passage 30, the radial hole 31 and the longitudinal hole 32 formed in the body 2.

The solenoid valve 28 is actuated by the current generated by the control circuit. When energized, the solenoid valve 28 displaces the needle 29, letting the fuel in the suction space 33 adjusted at a certain pressure flow through the valve hole 34 into the throttle 35 where it is metered. The throttle 35 of the solenoid valve 28 is connected with the injection connecting hole 36, the inlet port 20. When the solenoid valve 28' is energized;

the throttle 35' is connected with the timing connecting hole 37 and with the timing port 26.

When the shuttle 14 is at the extreme position or limit position near the delivery passage 18, the inlet port 20 is aligned with one of the inlet passages 21 and the timing port 26 with one of the timing passages 27. As for the fuel to be injected, as the solenoid valve 28 is actuated by the electric control circuit, the needle 29 is shifted open and the fuel in the suction space 33 flows through the valve hole 34, the throttle 35 and the injection connecting hole 36 to reach the inlet port 20 from which it is further led into the action chamber 19 on the side of the delivery passage 18. The fuel sent to the action chamber 19 acts upon the shuttle 14 to move it toward the radial hole 9 and at the same time move the plungers 12 and 12' outward.

Regarding the fuel that determines the injection timing, when the other solenoid valve 28' is actuated by the electric control circuit, the needle 29 is shifted open letting the fuel in the suction space 33 flow through the valve hole 34, the throttle and the timing connection hole 37 to reach the timing port 26, from which the fuel further flows into the action chamber 19 on the side of the timing passage 27 and then into the radial hole 9.

The amount of fuel entering the radial hole 9 determines the timing at which the fuel begins to be injected and supplied to the engine. Thus, the greater the amount of fuel entering the radial hole 9, the greater the plunger 12 will be shifted outwardly and the faster it will be driven inwardly by the annular cam 10 when the distributor 1 is rotating. The operation of the injection pump is described in detail in the Japanese patent application No. 55-13064.

As the distributor 1 further rotates, the delivery passage 18 becomes aligned with one of the delivery ports 16 and the relief passage 25 with one of the relief ports 22. As to the feeding of fuel, while the distributor 1 is rotating, the plungers 12 are forced inwardly by the annular cam 10 and the shuttle 14 is pushed toward the limit position on the side of the delivery passage 18 by the fuel pressure in the pressure pump chamber 23. At the same time, the fuel is injected from the action chamber 19 through the pressure valve 17 into the cylinder of the engine.

While the rear edge of the shuttle 14 covers the relief passage 25, the shuttle 14 is allowed to move. When the relief passage 25 is not closed, the further movement of the shuttle 14 is prevented and the residual fuel staying in the pressure pump chamber 23 is discharged through the relief passage 25, the relief port 22 and out into the outlet passage 30.

As the distributor 1 continues to rotate, the above-mentioned cycle is repeated.

Figure 2:
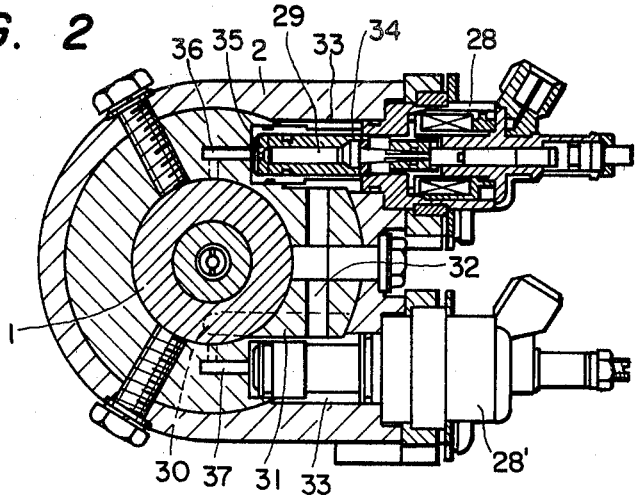
FIGS. 2 through 6 are cross sectional views of main portions taken along the line II—II, IV—IV, V—V and VI—VI of FIG. 1, respectively.
Figure 3:
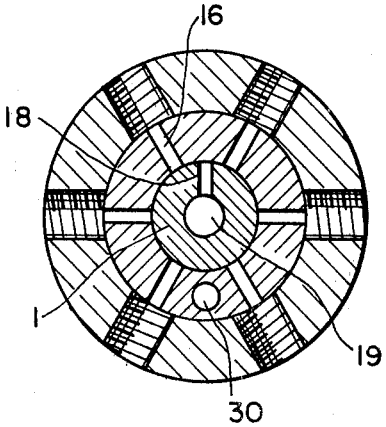
Figure 4:
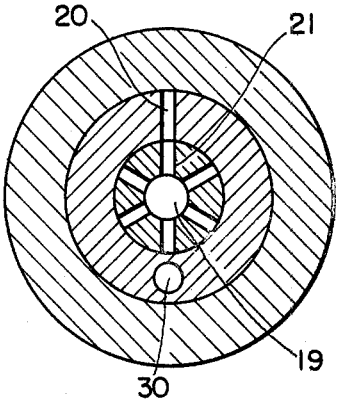
Figure 5:
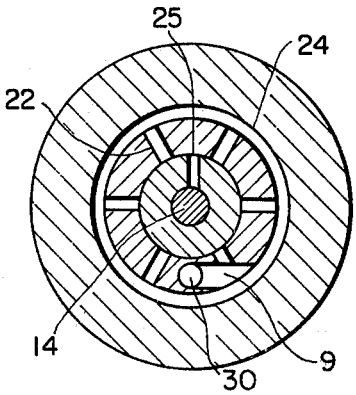
Figure 6:
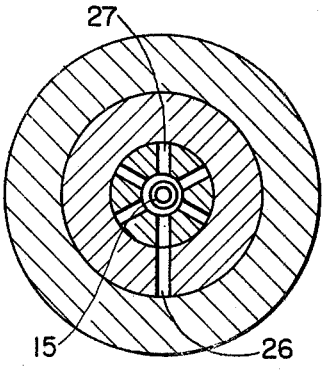

In this embodiment, the solenoid valve 28 is laterally disposed tangent to the rotating circle of the distributor 1, as shown in FIG. 2. This makes it possible to mount the solenoid valve 28 without having to enlarge the body 2 in the radial direction of the distributor 1, rendering the injector pump compact and light. This construction has strong resistance against the vertical vibration of the injector pump and therefore reduces erroneous operation of the solenoid valve.

We claim:

1. A fuel injection pump for internal combustion engines, the fuel injection pump comprising:

a body;

a rotary distributor installed in said body and adapted to be driven in synchronism with the internal combustion engines;

a pressure pump rotor installed inside said body and adapted to rotate together with said rotary distributor; and at least two solenoid valves mounted to said body so as to extend therefrom in the same radial direction, each of said solenoid valves including needle means for controlling the fuel supply to said rotary distributor, said solenoid valves being mounted in such a way that said needle valve means move in a direction tangent to a rotating circle of said rotary distributor, and a center axis of said at least two solenoid valves are disposed in parallel to each other.

2. A fuel injection pump for a delivery of a liquid fuel under high pressure to cylinders of an associated engine, the fuel injection pump comprising:

a body;

a sleeve mounted on said body and having a inlet port and a timing port, each port being communicated with a liquid fuel supply;

a rotor having a central axial bore and a radially extending hole formed therein, said rotor being inserted in said sleeve and rotated in timed relationship with the engine;

a pair of opposing plungers reciprocably disposed in the radially extending hole of said rotor;

a free piston reciprocably disposed in the central axis bore of said rotor so as to define first and second pressure chambers, the first chamber including a plurality of first timing passages and a relief passage and being communicated with the radially extending hole of said rotor, the second pressure chamber including a plurality of inlet passages and a delivery passage;

a first valve having a first needle valve for controlling the rate of suction of the liquid fuel into the first pressure chamber through the timing port; and a second valve having a second needle valve for controlling the rate of suction of the liquid fuel into the second pressure chamber through the inlet port, said first and second valves being mounted in such a way that said needle valves move in the direction tangent to the rotating circle of said rotor;

said pair of plungers being so constructed as to produce, in accordance with the rotation of said rotor, a compression period in which the liquid fuel is pressurized in the first pressure chamber and pressurized fuel in the second pressure chamber is supplied to the engine through the delivery passage, and a suction period in which the liquid fuel is supplied to the pressure chambers, wherein a timing of a discharge of the liquid fuel and a rate of discharge of the liquid fuel are controlled by controlling of the rate of suction of the liquid fuel into the first and second pressure chambers.

3. An fuel injection pump as claimed in claim 2, wherein the relief passage is opened when said free piston assumes a predetermined position, the relief passage being adapted to permit the liquid in the first pressure chamber to be divided and supplied to the low pressure section to thereby finish said compression period.

4. A fuel injection pump as claimed in claim 1, wherein the center axis of the solenoid valves are spaced from each other by a distance corresponding to at least a diameter of said rotor.

5. An air fuel injection pump as claimed in claim 2, wherein a center axis of said solenoid valves is disposed in parallel to each other.

6. A fuel injection pump as claimed in claim 2, wherein a center axis of said solenoid valves are spaced from each other by a distance corresponding to at least a diameter of said sleeve.

7. A fuel injection pump as claimed in claim 2, further comprising a cam means associated with said plungers for causing a periodic inward displacement of said plungers upon a rotation of said rotor.

* * * * *